US005258927A

United States Patent [19]

Havriluk et al.

[11] Patent Number: 5,258,927

[45] Date of Patent: Nov. 2, 1993

[54] METHOD AND APPARATUS FOR MEASURING PRESSURE EXERTED DURING AQUATIC AND LAND-BASED THERAPY, EXERCISE AND ATHLETIC PERFORMANCE

[75] Inventors: Rod Havriluk; Mary A. Havriluk, both of Tallahassee, Fla.

[73] Assignee: Swimming Technology Research, Inc., Tallahassee, Fla.

[21] Appl. No.: 678,116

[22] Filed: Apr. 1, 1991

Related U.S. Application Data

[63] Continuation-in-part of Ser. No. 468,618, Jan. 23, 1990, Pat. No. 5,005,140.

[51] Int. Cl.[5] ..... G06F 15/42; G06F 15/44

[52] U.S. Cl. ..... 364/550; 364/413.04; 482/111

[58] Field of Search ..... 364/550, 508, 413.04, 364/571.05; 482/55, 111

[56] References Cited

U.S. PATENT DOCUMENTS

| | | | |
|---|---|---|---|
| 4,311,306 | 1/1982 | Solloway | 482/111 |
| 4,411,422 | 10/1983 | Solloway | 482/111 |
| 4,416,451 | 11/1983 | Solloway | 482/111 |
| 4,458,896 | 7/1984 | Solloway | 482/111 |
| 4,468,023 | 8/1984 | Solloway | 482/111 X |
| 4,521,011 | 6/1985 | Solloway | 482/111 |
| 4,627,613 | 12/1986 | Solloway | 482/111 |
| 4,654,010 | 3/1987 | Havriluk | 482/55 X |
| 4,763,275 | 8/1988 | Carlin | 364/550 X |
| 4,763,284 | 8/1988 | Carlin | 364/550 |
| 4,774,679 | 9/1988 | Carlin | 364/550 |
| 4,819,951 | 4/1989 | Solloway | 482/111 |
| 5,005,140 | 4/1991 | Havriluk | 364/550 |
| 5,102,120 | 4/1992 | Lindblad | 482/111 |
| 5,116,295 | 5/1992 | Dunn et al. | 482/111 X |

*Primary Examiner*—Kevin J. Teska
*Attorney, Agent, or Firm*—McGlew and Tuttle

[57] ABSTRACT

A method and device for monitoring and measuring underwater physical therapy or exercise employing fluid elements in either enclosed compressible fluid filled chambers or aquatic exercise devices submerged in water. Measurements are taken via pressure ports formed on first and second opposite surfaces of the hydrodynamic device to provide a pressure differential signal. This pressure differential signal may be compared to a calibrated zero signal to form a measurement signal. The measurement signal is then converted to a digital signal for evaluation by a digital computer. The exercise performed may be stored and evaluated. The arrangement provides information with regard to the type of exercise performed and the degree of exercise performed.

14 Claims, 7 Drawing Sheets

METHOD AND APPARATUS FOR MEASURING PRESSURE EXERTED DURING AQUATIC AND LAND-BASED THERAPY, EXERCISE AND ATHLETIC PERFORMANCE

RELATED CASE INFORMATION

This application is a continuation-in-part of application Ser. No. 07/468,618 filed Jan. 23, 1990 which has matured into U.S. Pat. No. 5,005,140 issued Apr. 2, 1991.

FIELD AND BACKGROUND OF THE INVENTION

The present invention relates, in general, to measuring and monitoring schemes and, in particular, to a new and useful method and apparatus for measuring and monitoring the performance of a patient or athlete during physical therapy, exercise and also hydrodynamic therapy or exercise. Exercise using fluid resistance for patients undergoing physical therapy and athletes undergoing physical therapy has significant advantages over conventional exercise and physical therapy using conventional devices. Conventional devices are often awkward, cumbersome and complex and are not suitable for interchangeable use by men, women, and children having different physical capabilities and strengths without extensive modification. Additionally, many of the conventional exercise devices exert an excess amount of torque and torsion (twist) on the joints of the user and are therefore not usually suitable for many types of physical therapy and exercise.

Hydrodynamic devices have been proposed for use for physical therapy and exercise in water, thereby controlling more thoroughly the torque, torsion and resistant forces which are exerted on the joints of the patient. Various arrangements for aquatic exercise assemblies have been proposed including the arrangements taught by U.S. Pat. No. 4,311,306; 4,627,613; 4,411,422; 4,416,451; 4,521,011; 4,458,896 and 4,468,023, all of Solloway. Such hydrodynamic exercising arrangements are well-adapted for filling physical therapy needs. Unfortunately, the benefits of therapy within the water are somewhat lessened by problems relating to the inability to closely monitor the degree of exercise provided and the effect of the exercise on the patient. The use of such hydrodynamic arrangements, by repetitions or the like, does not necessarily guarantee that a specific amount of exercise has been completed (does not guarantee a predetermined amount of work has been performed) and that the exercise has been performed in the proper manner.

SUMMARY OF THE INVENTION

The present invention relates to exercise overcoming fluid resistance and to measuring aspects of physical exercise by sensing pressure changes in fluids in enclosed spaces which are in contact with a body part of a person using the arrangement and pressure exerted on surfaces by the person using the invention.

It is an object of the invention to provide a method and system arrangement for closely monitoring the use of a fluid dynamic exercise arrangement such as an aquatic exercise assembly, or one that uses another fluid such as air, such that the exercise may be performed in a correct manner with a force distribution which is observable and recordable and repeatable by using data as feedback to the patient.

The invention proposes employing fluid exercising assemblies i.e. hydrodynamic elements or land-based closed container arrangements. The closed container arrangements may be held or attached to a body part of the patient or athlete and may form part of a specific exercise device or act as part of athletic equipment such as athletic shoes or boxing gloves with a system including sensor elements and monitoring means for the observation and recordation of the exercises.

As an aquatic exercise assembly or hydrodynamic device, the invention employs a hydrodynamic resistance element, such as the elements of U.S. Pat. No. 4,311,306; 4,627,613; 4,411,422; 4,416,451; 4,521,011; 4,458,896 and 4,468,023. U.S. Pat. Nos. 4,311,306; 4,627,613; 4,411,422; 4,416,451; 4,521,011; 4,458,896 and 4,468,023 are hereby incorporated by reference.

One aspect of the present invention is drawn to an apparatus and method for measuring and observing the forces acting on surfaces of a hydrodynamic element by sensing a differential in pressure between surface sides of the hydrodynamic element. Another aspect of the invention provides a device using a fluid such as air or another gas in which the pressure differential is measured between a substantially enclosed chamber and a fluid at a known pressure such as ambient air. A calculation is made to determine the area under the curve, which area is directly related to the performance. According to the invention, the data may be presented to provide work information, force information and various other measurable quantities. These quantities are then analyzable with respect to aspects of exercise repetitions (such as peak force per repetition) and with multiple sensors, maps of force distribution on body parts).

The closed container arrangement may be used to measure pressure exerted during athletic performance, exercise or therapy. The closed container or chamber may be connected to data collection and analysis instrumentation similar to the apparatus described in U.S. Pat. No. 4,654,010.

The chamber may be designed in two basic configurations. In the first configuration the chamber is primarily used to measure pressure exerted during an activity. In the second configuration the chamber is used to measure pressure and provide resistance to a movement such that the patient or athlete exerts a force to overcome the resistance.

In the first configuration the chamber may be relatively small so that it senses the impact exerted by a body part on an external surface. This configuration is most suitable for use in an activity such as running or boxing. In this case the force of impact is sensed by a pressure change in the closed container which provides information regarding the force of the individual impact and also the number of such impacts over time.

The surface area of the chamber may vary from a fraction of the impact surface area to the entire surface area. Depending on the activity, the chamber may be embodied in any shape such as a circular or rectangular shape depending on the application. The thickness of the chamber is necessarily minimized so as not to interfere with the activity. The chamber may be sealed to prevent the escape of the fluid medium, which would usually be air.

The fluid chamber is superior to actually positioning a sensor (e.g. force transducer) between the body part and the impact surface because the chamber requires less distortion of the surface that contacts the body part and causes no discomfort to the performer. In addition, there is less wear on a sensor attached to a chamber as opposed to a sensor positioned between the body part and the impact surface.

Sensors may provide feedback with regard to pressure exerted on impact of various chamber (plural chambers) during athletic activities such as running or boxing. In this way the athletes' technique may be modified to minimize injury or maximize effective aspects of a movement.

Chambers may also be positioned at key locations on a horse used in equestrian events. For example, circular shaped chambers of one or two inches in diameter may be located on the sides of the horse or on the medial surface of the riders knee where the medial surfaces of the rider's knees are meant to exert pressure on the horse. The chambers could also be positioned to measure pressure exerted by other body parts of the rider or on different areas of the horse's body. The pressure exerted by the rider on the chambers may be monitored along with the response of the horse to determine threshold values for the pressure necessary to elicit certain responses. Pressure threshold values may be compared between horses to aid in matching a rider with the most appropriate horse.

A pressure system may also provide quantitative feedback during training. Such feedback may help a rider or other athlete to avoid injury by indicating when to terminate a training session if the pressure values indicate fatigue. The information would also be useful to determine when a rider might confuse the horse by giving inappropriate leg pressure signals because of fatigue.

Chambers may be positioned on the same key locations on a model of a horse to train riders to exert the required pressure necessary to elicit certain responses. A rider may train on a simulator equipped with pressure sensors when unable to train on a real horse due to time, expense, or injury. Since the level of attainment in dressage depends on both the skill and ability of the horse and rider, the simulator pressure system may be used to advance the skill of the rider independent of the horse. A rider may advance from training level to Olympic level skills without the availability of an Olympic level horse.

In the second configuration the purpose of the chamber is two-fold: to sense the pressure exerted and also to provide resistance to a movement. This configuration requires a larger chamber than the first configuration and would be most suitable for use in exercise or therapy. In this case the surface area of the chamber approximates the contact surface of the body part. The chamber operates in a similar manner to a bellows to provide resistance throughout the range of motion. A wedge-shaped bellows is proposed which allows the thickness of the chamber to vary along the contact surface and thereby provides an equivalent resistance along the entire contact surface throughout an angular displacement of a body part.

A wedge-shaped bellows allows the chamber to be positioned with the point of the wedge at a joint and the contact surfaces strapped to the opposing limbs of the joint. This arrangement is suitable for providing resistance and measuring pressure throughout the range of movement at the elbow, knee, shoulder, or ankle.

This same wedge-shaped bellows may be positioned between a body part and a fixed external surface such as a bed, table or floor, as shown in FIG. 4A. This provides resistance and therefore measurement throughout the range of motion for body parts without convenient opposing limbs. When the performer is in either a face-up or face-down horizontal position, this arrangement would be suitable for exercising and providing therapy for the neck, shoulder, hip, or ankle.

Straps may be employed to secure one contact surface of the chamber to the body part. Handles may be used to extend from both sides of the opposing contact surface so that the handle is held against the supporting surface by either the performer or the therapist as the body part is returned to the starting position and the chamber reinflated. The opposing contact surface may also be sufficiently weighted to hold it in place against the supporting surface and allow reinflation during the return of the body part to the starting position.

Two valves are preferably installed in a side wall of the chamber to regulate air flow in and out of the chamber and provide a constant resistance throughout the range of motion. The exhaust valve restricts air flow out of the chamber as the chamber is collapsed. The intake valve allows air to reinflate the chamber as the body part is returned to the starting position. Both valves may be adjustable so that the resistance may be varied for both the agonist and antagonist movements. This also allows the ratio of agonist to antagonist resistance to be customized to an individual's needs.

An advantage of the therapy and exercise configuration is that it may be used by individuals confined to bed. Since the chamber may be strapped to the performer in a variety of body orientations, the system provides an exercise alternative that accommodates restrictions in an individual's ability to achieve positions required for more conventional methods of therapy and exercise.

Another advantage is that the system allows the performer to exercise at extremely low levels of exertion. A therapy program begins with the performer simply letting gravity exert force on the body part and deflate the chamber. As the program progresses, increases in effort exerted against the chamber may be monitored as well as the time required to deflate the chamber.

The system decreases the probability of re-injury. There is no danger to the performer in pausing the exercise at any point throughout the range of motion. The accommodating resistance of the chamber simulates the resistance of exercising in the water. The system is a logical precursor to, or may be used in conjunction with, water therapy and exercise. Measurements taken out of the water may be compared to values for water exercise using the equipment described in other patents developed by the inventor (U.S. Pat. No. 4,654,010 and U.S. patent application Ser. No. 468,618 which has matured into U.S. Pat. No. 5,005,140 issued Apr. 2, 1991).

It is a further object of the invention to provide a fluid dynamic therapy monitoring arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 2:
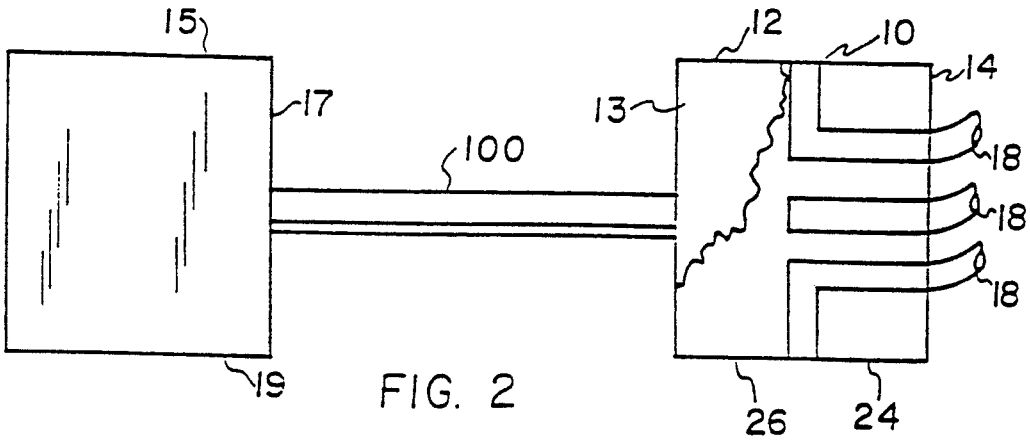
FIG. 2 is cross-sectional view showing an arrangement of pressure elements on an aquatic exercise assembly according to the invention.
Figure 1:
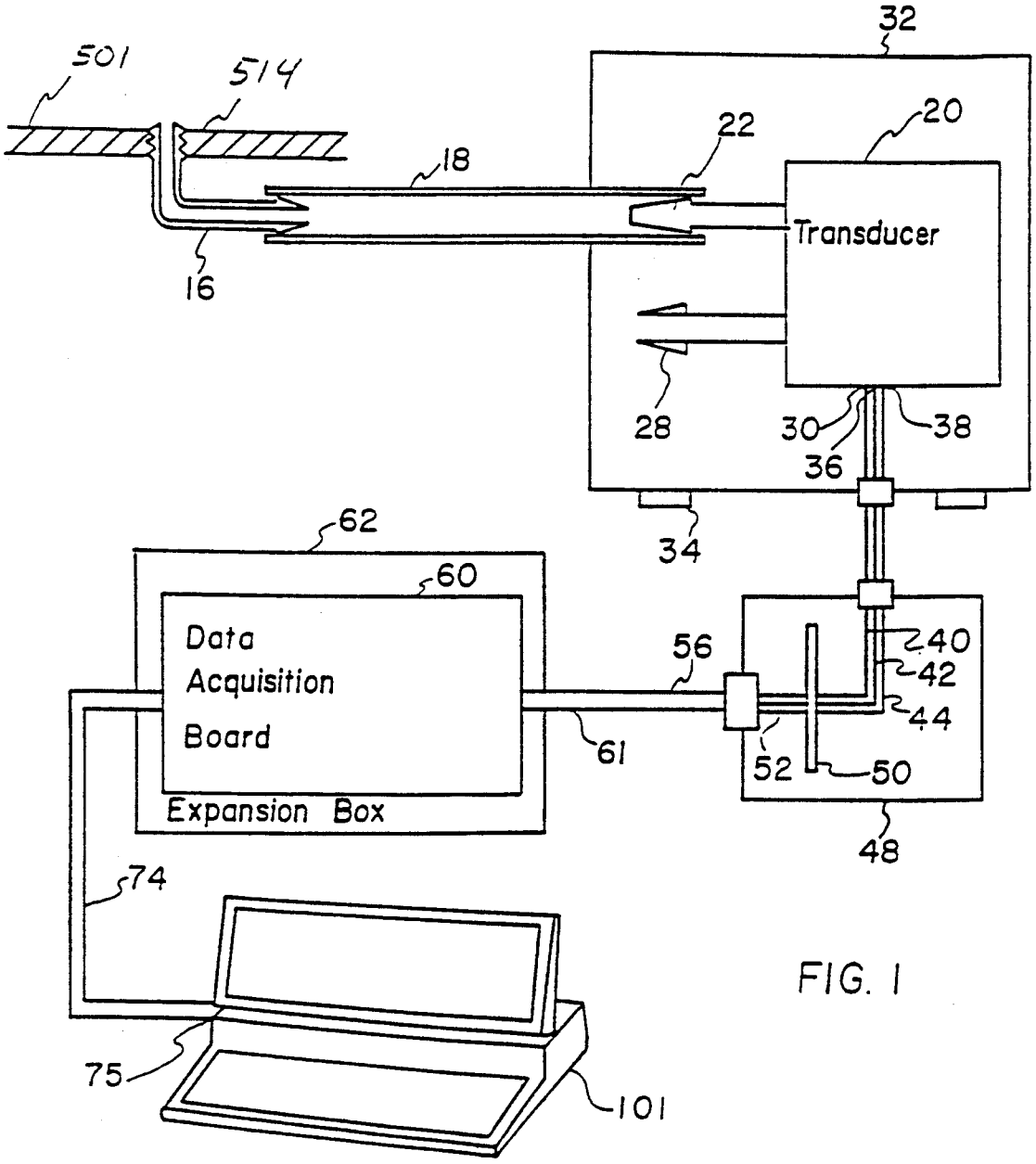
FIG. 1 is a schematic view showing a system and device in accordance with the invention.

Referring to the drawings, in particular, the inventive system preferably includes a remote port 10 provided in a surface 12 of a hydrodynamic element 14 or a remote port 514 provided in a surface 501 of an enclosed space exercise arrangement 500. The remote port 10 is exposed to the pressure acting perpendicular to the submerged surface 12. The remote port 514 is exposed to the pressure of the gas within the enclosed space exercise arrangement The remote port 514 is connected to a transducer 20 by plastic tubing 516. In this way, pressure is relayed via the plastic elbow joint 16 (such as CRAFTECH part no. 0302-1 or VALUE PLASTICS # KL230-2) and plastic tubing 18 to a connection port 22 of the transducer 20. For attachment to some arrangements, a straight plastic conductor 301 (such as CRAFTECH part no. 0300-5 or VALUE PLASTICS #K230-2) may mount the remote port in the most advantageous manner (see FIG. 5).

The transducer 20 (such as MOTOROLA Model MPX-3100 DP) measures fluid pressure in a line or provides a differential pressure signal representing two sensed pressures.

A second remote port 24 is provided on an opposite surface 26 of the hydrodynamic element 14. The second remote port 24 is connected to a second connection port 28 of the transducer 20 by means of an elbow joint and plastic tubing in the same manner as the first remote port 10. The remote ports 10 and 24 are mounted on different sides of an arrangement such as a hydrodynamic element, such as element 14, to allow a differential pressure to be measured at the transducer 20.

Depending on the orientation of the transducer, the remote port may not be necessary. In some cases the pressure may be sensed directly at the transducer ports 22 and/or 8 by positioning the transducer ports in or on the hydrodynamic device or enclosed space arrangement.

Transducer 20 is advantageously enclosed in a plastic box 32 which can be mounted to a surface by support elements or feet 34.

The transducer 20 includes terminals, such as output 30, ground 36, and voltage 38. These terminals are connected via a cable or wires, respectively 40, 42, 44 to the calibration circuit board 50. The calibration circuit 50 board is preferably positioned within a plastic box 48 (such as POLYCASE 883-043-1 with POLYCASE cover 883-0471) or a container of other material which is waterproof or may be waterproofed.

Figure 3:
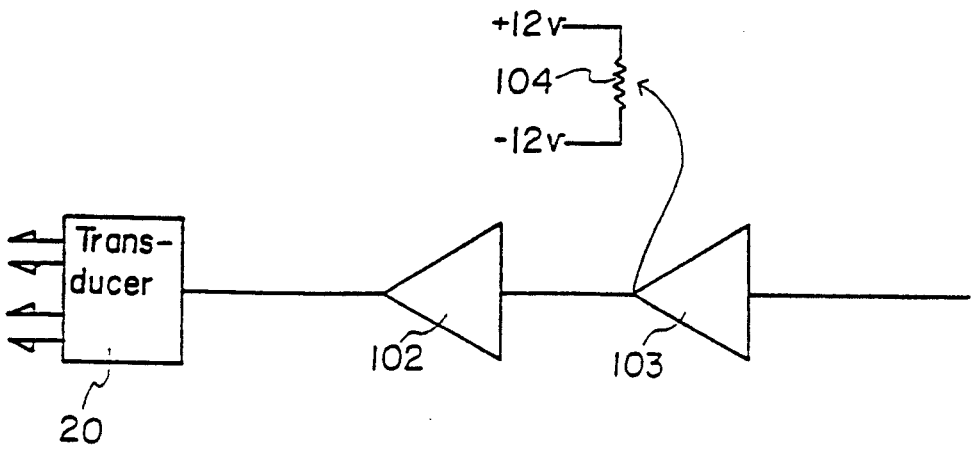
FIG. 3 is a schematic view showing the signal conditioning in the transducer arrangement.
Figure 4:
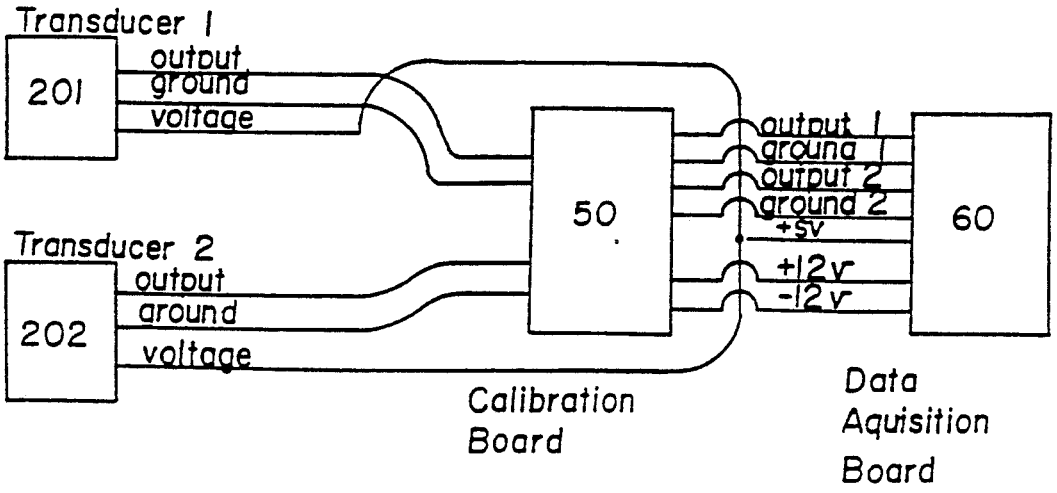
FIG. 4 is a schematic view showing the connection of the transducer to the calibration board and data acquisition board.

Referring to FIGS. 3 and 4 particular, the output of the transducer 20 is a voltage signal. This voltage signal varies directly with the differential pressure between the positive and negative ports. The calibration circuit 50 allows the base line voltage signal (representing the pressure differential) which is omitted from the transducer, to be adjusted so that the base line signal can be centered on a base line of the computer screen or the like. The adjustment may be made by turning the trimmer 104 which is mounted on the calibration circuit board 50. As shown specifically in FIG. 3, the signal from transducer 20 is first inverted by inverting amplifier 102 (i.e. gain equal negative 1). The output from the inverting amplifier is input into a second amplifier 103. The output from the trimmer 104 is also input into amp 103. The output from the trimmer 104 can be adjusted, thereby adding or subtracting voltage to the signal and allowing it to be centered on the desired base line. The output from amp 103 is input into the data acquisition board 60. The actual wiring of the arrangement is best shown in FIG. 4. The calibration circuit board 50 is wired to two transducers 201, 202. The output and ground (common) from each of the two transducers 201, 202 is wired to the board 50. The voltage connection to both transducers is connected directly to the plus 5 volt connection on the data acquisition board 60. The output of the calibration board 50 consists of an output and ground for each of the transducers connected. The calibration board also has a plus 12 volt and minus 12 volt connection to the data acquisition board to power the circuit. An eight channel arrangement may be provided with eight transducers which are to be wired to four calibration boards (two transducers per board). All the boards are preferably housed in a single enclosure or expansion box with output of the same data acquisition board.

The calibration circuit board 50 is provided with output terminals 52 connected to the output cable 56 which leads out of plastic box 48. The cable 56 is connected to a data acquisition board 60. The data acquisition board 60 (for example, METRABYTE Model DAS 8-PGA) may be mounted and housed in an expansion box 62, (for example, AXONIX, THINPACK Model 1100). The calibration circuit board 50 may also be placed in expansion box 62. The data acquisition board 60 preferably has eight analog channel inputs 61. This arrangement allows eight sensors on different pieces of equipment to be sampled simultaneously, or two sensors on four pieces of equipment, etc. This is extremely useful as it is possible to employ an enclosed space exercise assembly with a plurality of chambers thereby allowing a plurality of exercises using one setup, i.e. enclosed space exercise shoe 400 with four sensor connection lines 426, 428, 430 and 432 positioned on one exercise arrangement. Also different chambers may be monitored to provide additional information to check if the exercise is being performed properly. Additionally, absolute pressure transducers may be used in some configurations. Absolute pressure transducers allow measurement of ambient air pressure or the water depth when the transducer (or transducer remote port) is mounted on a surface parallel to the direction of movement of the hydrodynamic device.

The expansion box 62 is advantageously connected to a lap top computer 70 preferably secured beneath the lap top computer 70). The lap top computer 70 may be, for example, TOSHIBA MODEL T1100+. The expansion box 62 may simply be connected by a cable 74 to the expansion slot 75 of the computer 70. Of course, a standard desk top type personal computer or the like may also be employed. Additionally, a lap top computer (e.g. Dell Computer Corporation Model 316 LT) which can receive a data acquisition card, (e.g. Metrabyte Model DAS-8) internally, and still have sufficient battery power would be most advantageous. Such arrangements provide even further advantages with regard to the ease of use and mobile aspects of the entire system.

FIG. 2 shows a preferred arrangement employing an aquatic exercise assembly 100 or aquatic dumbbell including hydrodynamic portions 14 with surface 13 and other surfaces not shown. With this arrangement, it is possible to evaluate information with regard to the force acting on one of the perpendicular sets of surfaces. It is also possible to provide additional parts which are redundant ports for an even more accurate measurement or to check for error and to measure twisting motion or differences due to depth.

Several alternative arrangements are possible without departing from the principles of the invention. For example, individual pressure transducers may be mounted on surfaces of the aquatic exercise device and then directly wired to the calibration circuit board 50 or transmitted via a transmitter to a receiver which is connected to the calibration circuit board 50. Such a transducer and transmitting arrangement is disclosed in my U.S. Pat. No. 4,654,010, which is hereby incorporated by reference.

Figure 5:
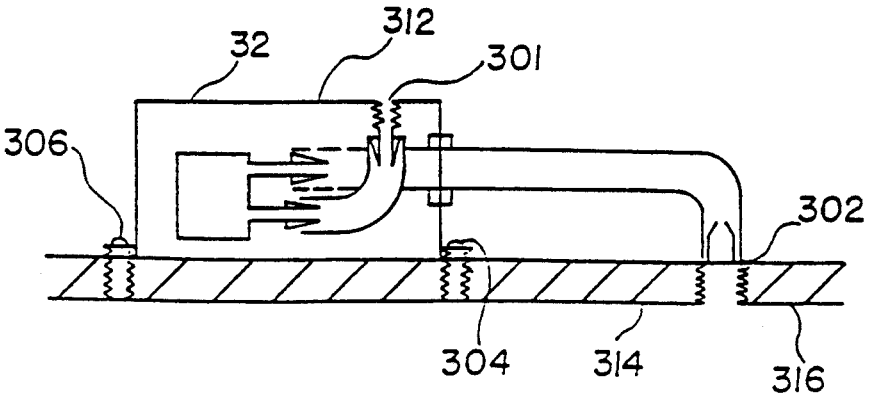
FIG. 5 is a cross sectional view showing an alternative mounting of the transducer arrangement according to the invention.
Figure 6A:
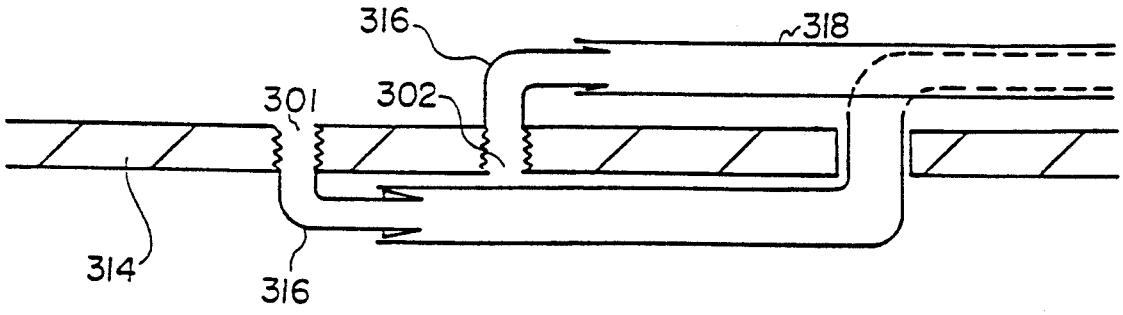
FIG. 6*a* is a view showing a preferred positioning of remote ports on a thin hydrodynamic element.
Figure 6B:
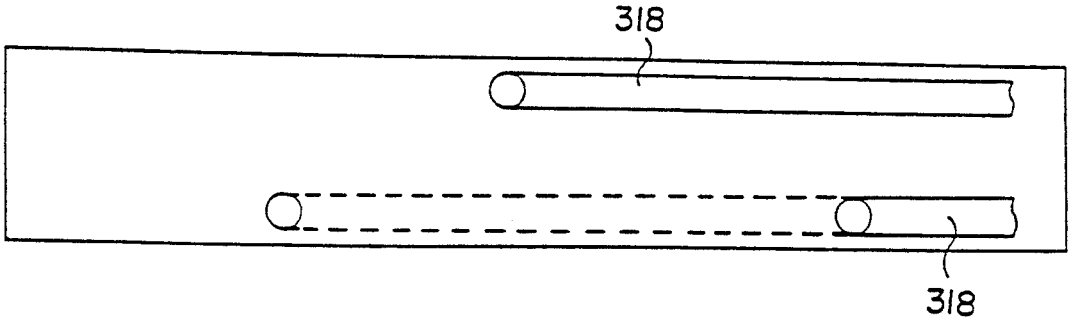
FIG. 6*b* is a top view of the arrangement shown in FIG. 6*a;*

As seen in FIG. 5, and as discussed above, the transducers such as transducer 201 and 202 are available in a size which is small enough to provide the transducers within an enclosure 32 which may be attached to a hydrodynamic surface such as thin hydrodynamic surface 314. The enclosure 32 may be connected by plastic screws or connectors 306 and 304 mounting the feet of the enclosure 32 to the surface 314. As shown in FIG. 5, pressure ports 301 and 302 may be provided in a simple manner with the pressure port 301 being provided in a surface 312, the surface forming part of the enclosure 32. The other port 302 may be provided connected to the surface 316. This arrangement provides an alternative to having the transducers provided a distance from the remote pressure ports. FIG. 6*a* and 6*b* show still another embodiment of the invention in which a relatively thin hydrodynamic surface at 314 is provided with remote ports 301, 302 which are connected to the transducers 201, 202 or the like by a plastic elbow joint connector 316 (such as CRAFTECH part no. 0302-1 or VALUE PLASTICS no. KL230-2). These connectors may be connected to plastic tubing or the like 318.

In the arrangement shown in FIGS. 6*a* and 6*b*, the pressure ports 301 and 302 are shown off set, for illustration purposes. It should be understood that the ports may be in alignment one behind the other or several other possible arrangements without departing from the concepts of the invention.

Figure 7:
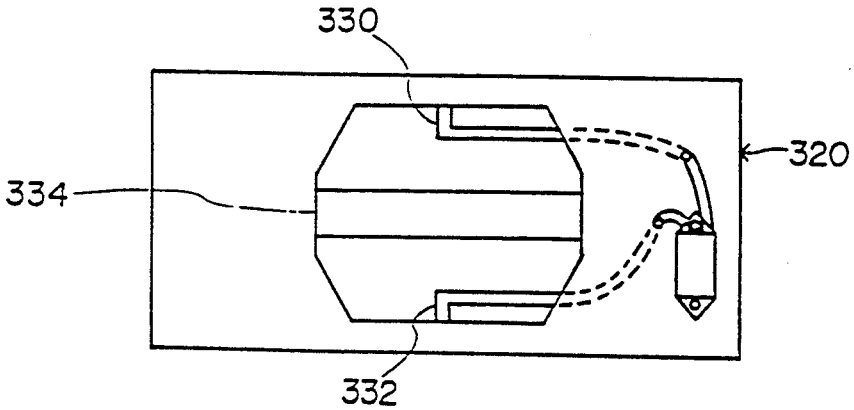
FIG. 7 is a cross sectional view of a barbell aquatic exercise assembly with a pressure transducer mounted thereon.

FIG. 7 depicts a hydrobell hydrodynamic arrangement 320 with pressure ports 330 and 332 arranged on opposite surfaces. The hand of the user may be clasped around the handgrip 334. The tubing is provided away from the user (as far away as possible such that it does not interfere with the exercise). The ports, tubing and sensor may also be installed inside the handgrip as an alternate arrangement.

The data which is provided to the computer of the system can be evaluated in many ways. The system of the invention may employ software to display a graph or the like of differential pressure versus time. The sampling rate for therapy and exercise purposes is generally about 50 samples per second. However, the system designed in software allows sampling in rates of about 250 samples per second without changes in hardware or any other problems. The pressure may be converted into units of force so that by integration of the curves produced during exercise, peak force, average force, impulse and number of repetitions may easily be calculated. If the distance of the movement is also measured by some means other than the sensors of the invention (such as entering distance data into the computer of the system), work, power, and torque can also be calculated.

Software may also be provided for allowing the adjustment of the base line pressure to be handled through the computer. It has been observed that such a software base line adjustment works best for fine adjustment, where as the hardwired hardware adjustment by the calibration board is better for more course adjustment. Software may also provide for channel switching, gain switching and to stop and start data collection. All of these functions may also be controlled by hardware switching. However, such software switching makes the equipment completely controllable at the keyboard and also eliminates the parts necessary for the switch box and the connecting cables. However, in some cases an external on-off switch may be more consistent with typical situations (i.e. the coach could use the external on-off switch as a stop watch which could also start and stop data collection).

The above arrangement may also be used for analyzing and observing swimming technique provided the swimmer is stationary. This is accomplished using water treadmills or swimming flumes or where the swimmer is tethered.

According to a further variant of the system of the invention, the remote pressure ports may be provided connected to closed containers to thereby sense the pressure in the closed containers. This arrangement can be used especially for impact situations such as running, boxing, handball and the like.

Figure 8:
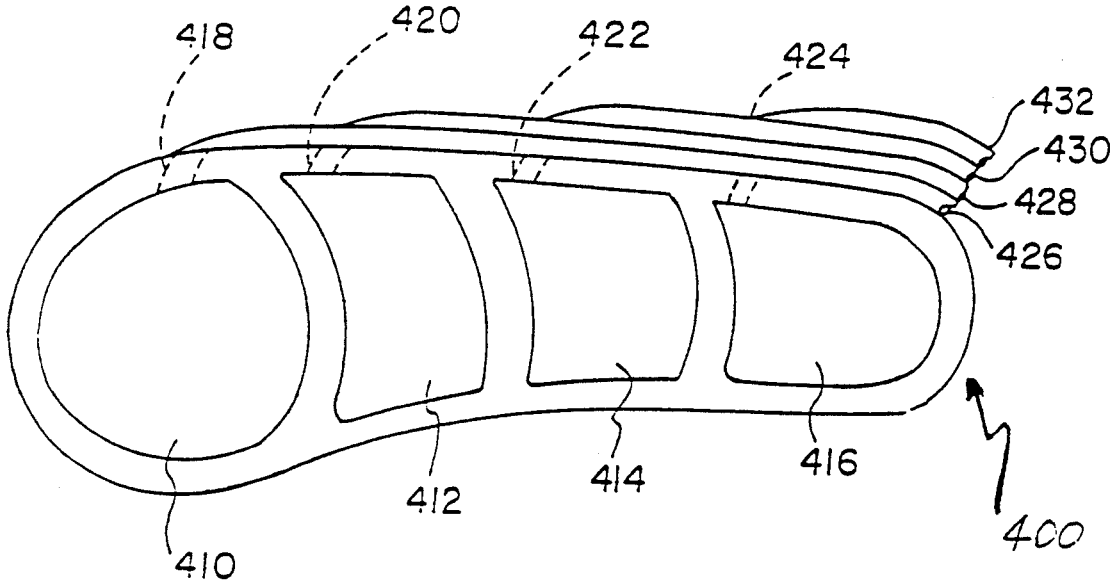
FIG. 8 is a cross sectional view of an exercise element with closed containers and remote pressure ports for measuring the pressure in the closed containers using the system of the invention.

Referring to FIG. 8 in particular, the arrangement according to a further aspect of the invention includes a plurality of closed containers 410 through 416 which are each connected to a pressure port such as remote pressure ports 418 through 424. Each of these remote pressure ports may be connected by tubing to a port of one or more transducers such as transducers 201, 202. The closed containers 410 through 416 preferably are filled with air. According to the arrangement of FIG. 8, the closed containers 410 through 416 are provided in a sole structure of an athletic shoe such as a running shoe or the like. The closed containers are each provided at locations to sense specific information. For example, in the case of running, it may be desirable to provide several closed containers 410 through 416 positioned at important locations such as the ball of the foot (410), the arch of the foot (414) or the heel of the foot (416). More containers and more pressure ports may be provided as desired. According to a preferred arrangement, the pressure ports 418 through 424 are connected to pressure conduit tubes such as 426 through 432, respectively. Tubes may be connected to the transducer at the shoe or the tubes may be run up to a central transducer arrangement such as transducer arrangement 20 which may be strapped to the user or the like.

Figure 9:
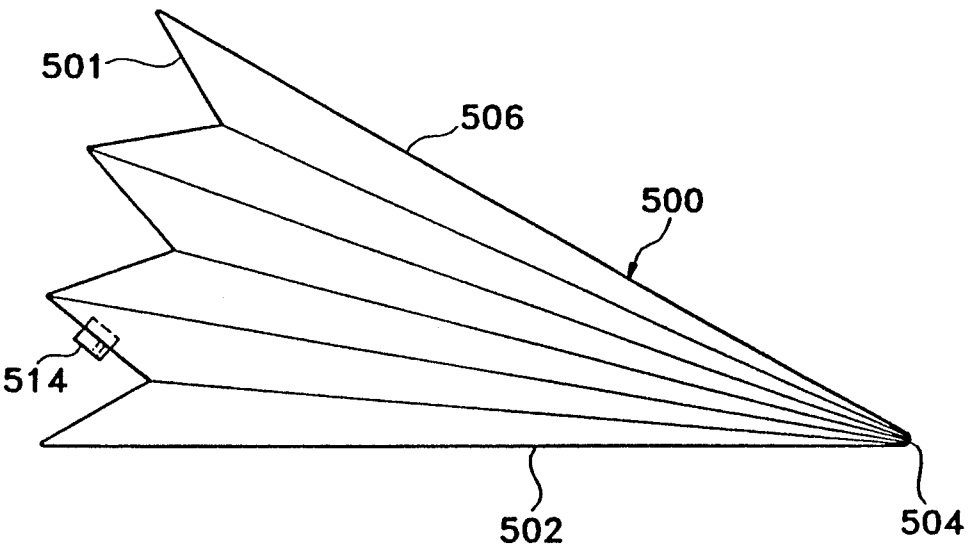
FIG. 9 is a front view of an exercise device according to the invention embodied as a large chamber.
Figure 10:
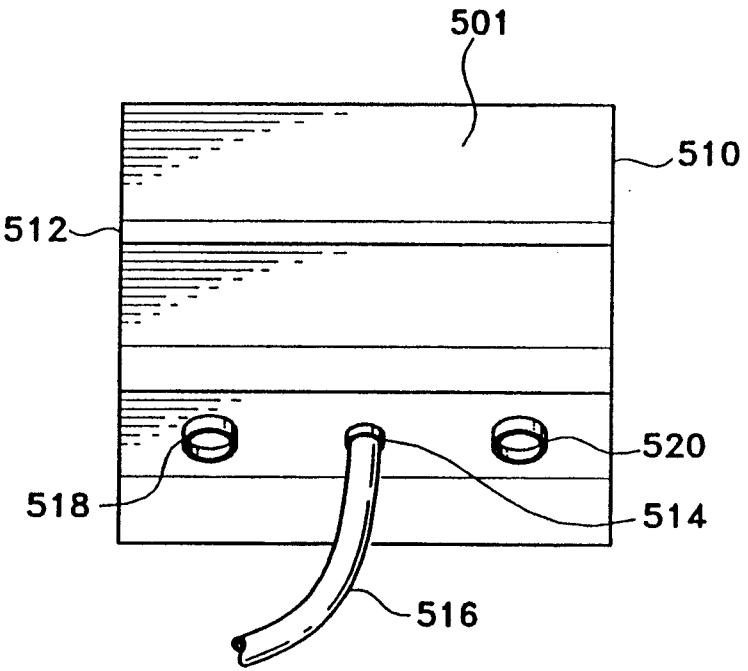
FIG. 10 is a left side view of the exercise device shown in FIG. 9.

FIGS. 9 and 10 show an enclosed space exercise arrangement or a bellows shaped arrangement generally designated as 500. The bellows 500 includes a top wall 506 and a bottom wall 502. These top and bottom walls (506 and 502) hingeably connected at a pivot point 504 to a top wall 506. Opposite the pivot point 504 is a collapsible end wall or bellows wall 501. The arrangement is enclosed and made airtight by collapsible side walls 510 and 512. Similar to port 302 as shown in FIG. 5 the bellows 500 includes a pressure port 514. Connected to the pressure port 514 is an interface cable 516 which is connected to a pressure transducer port 22 of transducer 20. The other transducer port may be exposed to atmosphere for a base comparison. The bellows 500 also includes an intake valve 518 which may be adjusted to regulate the resistance of air flowing through it. The bellows 500 also includes an exhaust valve 520 to regulate the resistance of air flowing out of the bellows.

Figure 11B:
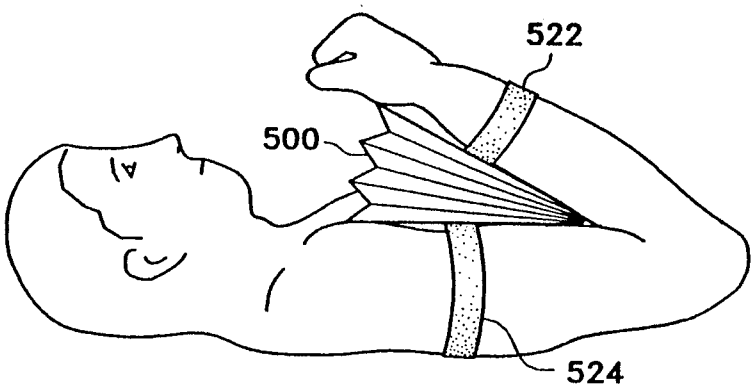
FIG. 11*b* is a view of the device according to FIG. 11*a* in a deflated state.
Figure 11A:
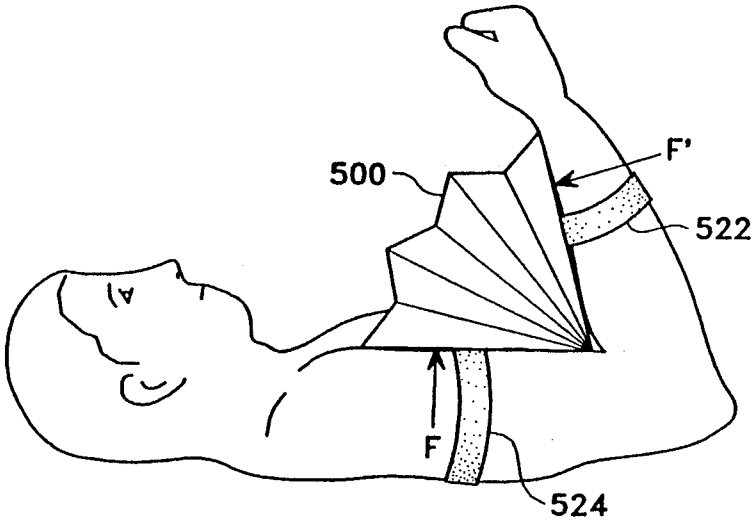
FIG. 11*a* is a view showing the device shown in FIG. 9 being utilized as an exercise element.

Referring now to FIGS. 11*a*, 11*b*, and 11*c* the bellows 500 is shown being utilized as an exercise/therapy device wherein the forces exerted F and F' collapse the bellows 500. The force is determined from the pressure read from the pressure port 514. The force required to compress the bellows is regulated by exhaust valve 520. The reverse motion, to open the bellows, is provided by the subject pulling against straps 522 and 524. The force required to open the bellows is regulated by intake valve 518. The performance of the subject is recorded and displayed by computer 100.

Figure 12B:
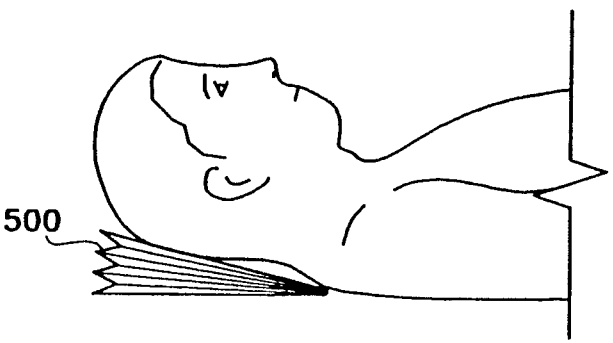
FIG. 12*b* is a view of the device shown in FIG. 12*a* in a deflated position.
Figure 12A:
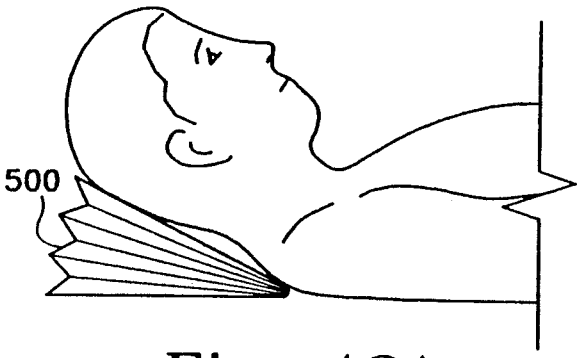
FIG. 12*a* is a view of the device shown in FIG. 9 positioned between a body part and a fixed external surface.

FIGS. 12*a*, and 12*b* show the bellows 500 used against a stationary surface such as a floor or a bed. The bellows 500 behaves similarly to the bellows shown in FIGS. 11*a* and 11*b* except the expansion of the bellows 500 is provided by resiliency in the collapsible side walls 510 and 512 and end wall 508, or by another appropriate biasing means (not shown). The intake valve can be completely opened or slightly closed to damp the re-expansion forces.

Figure 15:
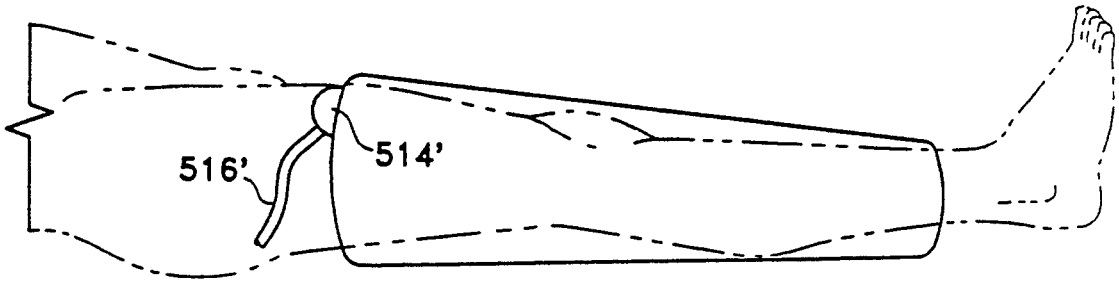
FIG. 15 is a right side view of the pressure analysis device used with a known inflatable leg splint to enable the pressure inside the splint to be continuously monitored.

An alternative for the bellows would be a commercially available chamber, such as the AIR SPLINT (JOBST INSTITUTE, INC.; U.S. Pat. Reg. 26046). After the AIRSPLINT was inflated around a joint (see FIG. 15), the valve could be connected to transducer 20 via port 22 and tubing 18. Once connected, the valve could be opened and the pressure within the AIRSPLINT could be monitored during exercise. Although such a system would require minor modification of existing equipment, it would lack the advantage of constant resistance throughout the range of motion as in the bellows system. The fluid within the AIRSPLINT would be trapped and pressure would increase with the range of motion at a joint. Provision of valves 518 and 512 between the interior and exterior of the AIRSPLINT removes this problem.

Figure 13:
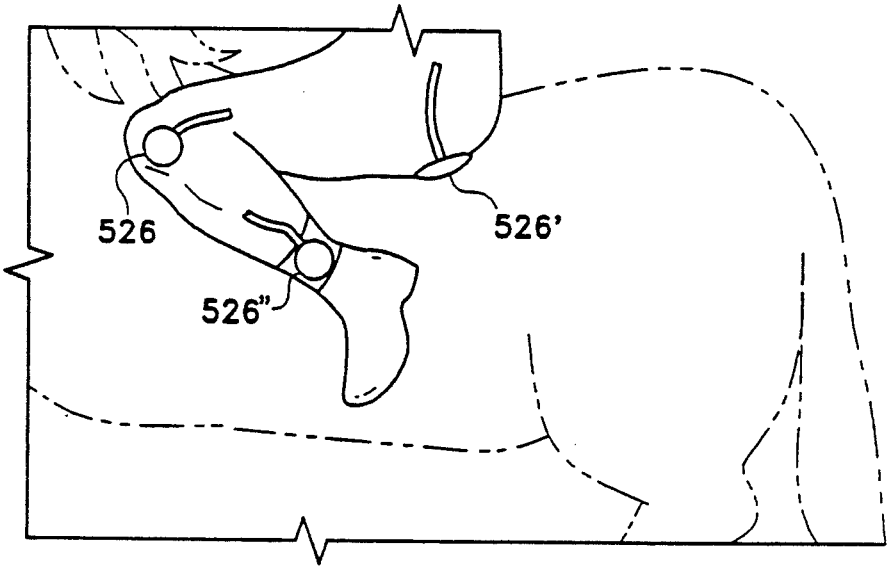
FIG. 13 is a view of the device embodied in an analysis capacity when measuring the pressure exerted by a rider on a horse.

FIG. 13 shows a right leg of a rider on a horse shown in phantom with the pressure system utilized by securing a closed container on either the medial surface of the rider's knee, or on the side of the horse.

Figure 14:
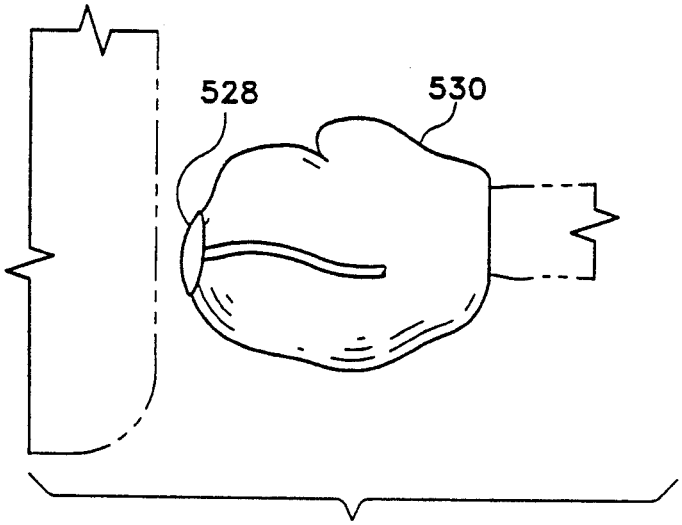
FIG. 14 is a view of the device embodied in a force analysis capacity on the impacting surface of a boxing glove.

FIG. 14 shows a closed container element 528 provided on a boxing glove 530 to measure impact force. A plurality of sensors may be used on the glove 530 surface to measure boxing technique and determine areas of greatest impact and as a feedback system to avoid injuries to the boxer's hands and arms.

Other sensing arrangements may be provided using the basic features of the invention without departing from the principles of the invention. While specific embodiments of the invention have been shown and described in detail to illustrate the application of the principles of the invention, it will be understood that the invention may be embodied otherwise without departing from such principles.

What is claimed is:

1. A system for monitoring and measuring exercise, comprising:

exercise element means defining an enclosed chamber including an opening defining a first remote pressure port defined by a first surface of said chamber, said exercise element means defining two surfaces to which force is applied during exercise; valve means for intake and exhaust of gas for exhausting gas from said chamber and intaking gas into said chamber to fill said chamber; a pressure/electrical signal transducer; a pressure conduit connecting said remote pressure port to said pressure/electrical signal transducer, said transducer for sensing pressure at said remote pressure port and for sensing atmospheric pressure and forming a differential signal representative of the difference between the pressure of the remote pressure port and atmosphere; calibration means for receiving electrical signals from said transducer means and for outputting a zero pressure signal prior to a data collection trial; data acquisition means for receiving said differential signal and said zero pressure signal and for outputting a digital signal representative of said differential signal, compared to said zero calibration signal.

2. A system according to claim 1, further comprising digital computation means connected to said data acquisition means for plotting a curve of said signal over time and for calculating an area under said curve.

3. A system according to claim 1, wherein:

said two surfaces of said exercise element means are attached at ends, said exercise element means including connection means for attaching said exercise element means about a joint of a person exercising, wherein movement at said joint changes pressure within said enclosed chamber.

4. A system according to claim 1, wherein:

said two surfaces are formed as semi rigid surfaces connected by a pivot at one end and connected by a bellows member at an opposite end.

5. An arrangement for monitoring and measuring physical exercise, comprising:

an enclosed container filled with a gas, said enclosed container including surfaces which are acted on by an individual engaged in the physical exercise; a pressure port formed in said container; transducer means including a pressure/electrical transducer port, said port being connected to said pressure port; calibration means for determining a base line signal based on a calibration period and outputting a pressure signal conditioned by said base line signal; and, computation means including an analog to digital converter, said computation means for receiving said conditioned signal and outputting digital data.

6. An arrangement according to claim 5 wherein said container is positioned on an exercise element including one of a shoe, boxing glove and equestrian device which further includes at least one additional container for measuring forces applied at a different location of the exercise element.

7. An arrangement according to claim 3, wherein:

said surfaces include a first surface and a second surface connected at ends, said enclosed container including connection means for connecting ends of said first and second surfaces around a joint of said individual engaged in the physical exercise.

8. An arrangement according to claim 7 further comprising:

valve means for intake and exhaust of gas for exhausting gas from said enclosed container and intaking gas into said closed container to fill said closed container.

9. An arrangement according to claim 5, wherein:

said surfaces include a substantially rigid upper surface and a substantially rigid lower surface connected by a pivot at one end and a bellows at an opposite end.

10. An arrangement according to claim 9, further comprising:

valve means for intake and exhaust of gas for exhausting gas from said enclosed container and intaking gas into said closed container to fill said closed container.

11. A method of measuring and monitoring athletic performance, comprising: sensing pressure in a closed container, carried by or attached to a person; converting the sensed pressure into an electrical signal representative of the sense pressure to form sensed pressure data; and storing the sensed pressure data for analysis.

12. A method according to claim 11, further comprising the steps of providing restricted openings for passage of gas between an exterior of said closed container and an interior of said closed container.

13. A method according to claim 11, further comprising providing digital computation means for plotting a curve of pressure values over time and for calculating an area under said curve based on said stored sense pressure data.

14. An arrangement for monitoring and measuring physical exercise, comprising:

an enclosed container filled with a gas, said enclosed container including surfaces wrapped around a joint of an individual engaged in physical exercise, said surfaces being acted on by an individual engaged in the physical exercise; a pressure port formed in said container; transducer means including a pressure/electrical transducer port, said port being connected to said pressure port; calibration means for determining a base line signal based on a calibration period and outputting a pressure signal conditioned by said base line signal; and, computation means including an analog to digital converter, said computation means for receiving said conditioned signal and outputting digital data.

* * * * *